United States Patent [19]

Shibata et al.

[11] Patent Number: 4,515,350

[45] Date of Patent: May 7, 1985

[54] SIMULTANEOUS MULTI-POINT SOUNDING APPARATUS

[75] Inventors: Yoichi Shibata, Yokohama; Ryosuke Kimura, Tokyo; Takashi Sumigama, Yokohama; Masaro Izumi, Kawasaki, all of Japan

[73] Assignee: Nippon Kokan Kabushiki Kaisha, Tokyo, Japan

[21] Appl. No.: 534,579

[22] Filed: Nov. 7, 1983

Related U.S. Application Data

[63] Continuation of Ser. No. 273,447, Jun. 15, 1981, abandoned.

[30] Foreign Application Priority Data

Jun. 16, 1980 [JP] Japan ..... 55-82933

[51] Int. Cl.[3] ..... C21B 7/24

[52] U.S. Cl. ..... 266/92; 266/99; 33/126.6

[58] Field of Search ..... 266/80, 94, 90, 99, 266/92; 33/126.6, 126.4 A, 126.5

[56] References Cited

U.S. PATENT DOCUMENTS 1,611,407 12/1926 Berg ..... 33/126.6

1,968,548 7/1934 Zimmerman ..... 33/126.6

*Primary Examiner*—L. Dewayne Rutledge

*Assistant Examiner*—S. Kastler

*Attorney, Agent, or Firm*—Moonray Kojima

[57] ABSTRACT

A simultaneous multiple points sounding apparatus, comprising a plurality of weights to be suspended on burden charged in a furnace, a plurality of wire ropes attached to the weights with their one ends and extending at their other ends outside of the furnace, and a plurality of wire drums installed outside of the furnace on which the wire ropes are coiled, and a single driving device on which a plurality of wire drums are communicated, wherein the plurality of wire ropes are disposed on pulleys which travel downward when the respective weights reach the burden, thereby lessening the tension on the respective wire rope, and detectors are disposed for detecting the downward movement of the respective pulleys.

5 Claims, No Drawings

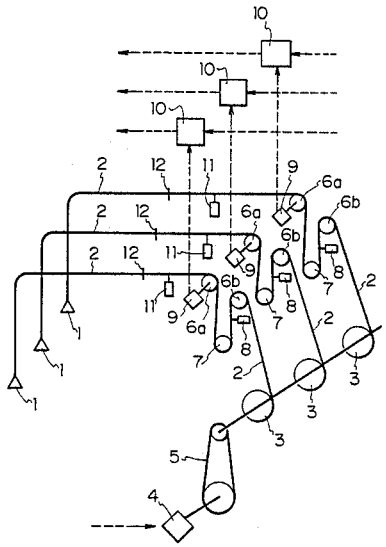

SIMULTANEOUS MULTI-POINT SOUNDING APPARATUS

This is a continuation of application Ser. No. 273,447, filed June 15, 1981, abandoned.

BACKGROUND OF THE INVENTION

This invention relates to a simultaneous multiple points sounding apparatus for measuring dispersion of burden charged in a furnace.

Furnaces, such as those used in steel making, have been recently enlarged in diameter of charging mouth, with larger scales thereof, and charged burden greatly influences the workings of the furnaces, with its dispersion at the charging mouth. For controlling the dispersion of the burden, there has been installed an apparatus, such as a movable armer, or the like, for controlling the dispersion of the burden below the charging apparatus. However, such prior art apparatus is deficient in that static information or data obtained through mere model experiments is insufficient for controlling usefully and exactly, dispersion of the burden. It is necessary to fully understand and have data on the dynamic distributing conditions existing in an actual furnace.

A sounding device may be used in such cases. Such an apparatus may comprise a weight suspended in a furnace by a wire rope and the dispersion condition of the burden can be detected by measuring the length of the rope drawn. Japanese Utility Model SN 158,652/1978 discloses a sounding apparatus comprising a plurality of weights suspended in a furnace and connected to a plurality of corresponding wire ropes, a plurality of drums for coiling the respective wire ropes, and a plurality of corresponding driving devices connected to the respective drums for simultaneously sounding a plurality of points within the furnace.

However, since the disclosed sounding apparatus has a driving device for each weight, a number of problems has arisen, such as increased production costs, increased maintenance costs and increased working space.

The present invention aims to improve the foregoing deficiency in the prior art, and encompasses a sounding apparatus wherein a single driving device operates a plurality of drums, each driving a respective wire rope to which is attached a respective weight for selectively sounding the dispersion of burden in a furnace.

BRIEF DESCRIPTION OF THE DRAWING

The sole FIGURE of the drawing depicts an illustrative embodiment of the invention.

DETAILED DESCRIPTION OF PREFERRED EMBODIMENTS

In the drawing a plurality of weights 1 are disposed, for example, in different locations in a furnace. Connected to weights 1 at one ends are a plurality of ropes 2 and at the other ends to a plurality of drums 3, as depicted. The wire rope 2 runs out of the furnace (not shown), through guiding pipes (not shown), and extends outside of furnace to drum 3. The drums 3 are each coaxial and are communicated with a single driving device 4, via, a transmission device 5. The wire ropes 2 run along a pair of fixed pulleys 6*a* and 6*b*, and a positional movable pulley 7 disposed therebetween. The movable pulley 7 is restrained upwardly at a fixed point, and is movable downward due to its own weight.

The weight of pulley 7 and the weight 2 are related in the following:

$$\text{Weight of weight } \mathbf{1} > \tfrac{1}{2} \times \text{weight of pulley } \mathbf{7}$$

In this manner, when weight 1 hits a charged burden, its corresponding pulley 7 will fall downward because of the lessening of tension on the respective wire rope. It is the lessening of the tension on the respective rope which is made up by the pulley 7, and the movement downward of the pulley 7 is the means by which simply and efficiently, the dispersion of burden can be determined. The movable pulley 7 may be a tension pulley on which tension acts in the downward direction. In this case, it is preferable to control the downward tension in relation to the weight 1. Limit switches 8 are disposed near the top position of the pulley 7 and acts as detectors for detecting the downward movement of the pulley 7. For example, when a particular one or more weights 1 hit the charged burden, there will be a lessening of tension on the respective wire 2, and its corresponding pulley 7, which will then move downward from the top position. Switch 8 will then detect this downward movement of pulley 7 and send a signal to signal processor 10 of the new condition.

At the fixed pulleys 6*a* are provided rotation number detectors 9, for determining the drawing length of rope 2 from the number of rotations of the pulley 6*a*. For detecting the completion of coiling of weight 1 to a top position, strikers 12 are disposed at appropriate positions along wire ropes 2. Limit switches 11 are disposed near the ropes 2, for detecting the position of the weights, such as in the top position. Thus, when the ropes 2 are coiled by drums 3 and reach a point where strikers 12 pass limit switch 11, the operator will know that the weights have reached their top positions. A control means or human operator can then have the driving device 4 stop and allow the weights to drop by weight of gravity without any downward control, or control the descent of the weights by braking reverse movement of the driving device 4, or a simple mechanical brake.

The rotation number detectors 9 and limit switches 8, and 11 are connected to signal processors 10, respectively. Signal from limit switch 8 is applied to processor 10 as a hold signal for holding rotation number signal from detector 9, and signal from limit switch 11 is applied to processor 10 as a reset signal for clearing the contents of the processor 10. The signal processor 10 processes the rotation number signal from detector 9 and generates and applies a signal of the drawing length of the wire rope 2, i.e. a sounding signal, to an indicating device, a central processing unit, or other measuring device. The signals from the limit switches 8 and 11 are transmitted to an operating chamber or control device (not shown) and the driving device 4 is operated by these signals.

In this embodiment, drum 3 may be provided with a torgue limiter to prevent overcoiling of the wire ropes. For driving device 4, a motor, with suitable braking arrangement, may be employed to check the gavity pulled movement of the weight 1 after the motor stops.

In operation, drum 3 is rotated by driving device 4 to coil rope 2 and bring up weight 1 completely to a top position. From this position, weight 1 is allowed to fall by force of gravity. At this time, signal processor 10 is caused to be reset by a signal from switch 11 actuated by striker 12. Since rope 2 is effected with tension by weight of weight 1, pulley 7 is acted on with an upward force, and pulley 7 is caused to be in its top position. Fixed pulley *6a* rotates as weight 1 falls. The rotation of the fixed pulley *6a* is detected by detector 9, and a signal indicative of the number of rotations, is sent to signal processor 10. When weight 1 lands on the charged burden, the tension on the respective rope 2 is lessened, temporarily, and pulley 7 descends to make up the tension. Thus, even when driving device 4 continues to drive drum 3, wire rope 2 is not substantially lessened in tension. When pulley 7 moves downward to make up the lessened tension due to the respective weight coming into contact with the burden, rotation of pulley *6a* is stopped. This downward movement is detected by limit switch 8 and a signal is sent to processor 10 to hold the output of processor 10. Thus, the sounding is carried out at each of the landing points of weights 1. Downward movement of each pulley 7, corresponding to each of the measured points, that is, all weights 1, is detected with output of a signal from the respective limit switches 8. To reset the sounding apparatus driving device 4 rotates the drums and causes wire 2 to pull up weights 1. Pulley 7 goes up first and subsequently the weights 1 go up by the upward coiling of wires 2. Completion of coiling is detected by limit switch 11 when striker 12 contact switch 11. The output of limit switch 11 is transmitted to processor 10 to thereby reset the operation and the measuring process is completed. The driving device may rotate in either directions the drums to control the speed of ascent and descent of the respective weights.

In the present embodiment, three weights are shown driven by a single drive means 4; however, this invention is not limited to use of only three weights. The number of points to be measured can be increased or decreased.

Depending on the apparatus, the amount of drawing of rope is compensated by the descending pulley, and the landing point of the weight on the burden is detected by detecting the descending of the pulley. Thus, it is possible to exactly measure a plurality of points of the dispersion of burden within the furnace, by means of sounding apparatus efficiently utilize space, by using this invention.

The foregoing description is illustrative of the principles of the invention. Numerous other modifications and extensions thereof would be apparent to the worker skilled in the art. All such modifications and extensions are to be considered to be within the spirit and scope of the invention.

What is claimed is:

1. A simultaneous multiple points sounding apparatus comprising a plurality of weights to be suspended above burden charged in a furnace;

a plurality of wire ropes attached to respective ones of said weights at one end thereof and extending at the other end thereof outside of said furnace;

a plurality of drums disposed outside of said furnace for coiling respective ones of said plurality of wire ropes;

a single driving device connectable to said plurality of drums for concurrently driving said plurality of drums;

a plurality of first pulleys, each fixedly in a position between said furnace and said drums;

a plurality of second pulleys, each fixedly in a position between said first pulley and said drums;

a plurality of third pulleys, each movably positioned between said first fixed pulley and said second fixed pulley, whereby each said wire rope is threaded, in order, between said weight, said first pulley, said third pulley, said second pulley and said drum; and detector means for detecting downward movement of said third pulley;

whereby said plurality of weights are all concurrently wound upon with their respective connected wire ropes to a top position by said single driving device concurrently driving all of said drums, whereupon said driving device is stopped, and whereupon said plurality of weights are subsequently allowed to travel downwardly until one or more thereof hits a charged burden, whereupon the respective connected wire rope has tension thereon lessened temporarily and the rotation of said respective first pulley is concurrently stopped and said respective third pulley connected thereto thereupon travels downward to make up the lessened tension on said wire rope; said downward movement of said third pulley is then detected by said detector means, thereby to indicate the dispersion of said burden within said furnace.

2. The apparatus of claim 1, wherein said driving device drives said drums in both directions to control the speed of ascent and speed of descent of the respective weights.

3. The apparatus of claim 1, wherein said each of said plurality of weights has a weight which is greater than one half of the weight of the respective pulley.

4. The apparatus of claim 1, wherein said driving device drives said drum to pull up the weight to said top position, and then stops and allows the weight to drop until said weight hits a charged burden or until said weight hits a bottom position, whereupon said driving device thereupon drives the drum to pull up said weight to said top position.

5. The apparatus of claim 4, wherein said top and bottom positions are indicated by positions on the respective wires and communicated to a control means.

* * * * *